United States Patent [19]

Hiraoka et al.

[11] Patent Number: 4,958,613

[45] Date of Patent: Sep. 25, 1990

[54] INTERNAL COMBUSTION ENGINE WITH CRANKCASE VENTILATION SYSTEM

[75] Inventors: Toyoki Hiraoka, Tokyo; Yuichi Murakami; Nobuyuki Okitsu, both of Yokohama, all of Japan

[73] Assignee: Nissan Motor Co., Ltd., Yokohama City, Japan

[21] Appl. No.: 417,622

[22] Filed: Oct. 4, 1989

[30] Foreign Application Priority Data

Oct. 18, 1988 [JP] Japan ..... 63-135580[U]

[51] Int. Cl.[5] ..... F02M 25/00

[52] U.S. Cl. ..... 123/572

[58] Field of Search ..... 123/572, 573, 574

[56] References Cited

U.S. PATENT DOCUMENTS

| | | | |
|---|---|---|---|
| 3,050,043 | 8/1962 | Barusch | 123/572 |
| 4,493,295 | 1/1985 | Ampferer | 123/572 |
| 4,515,137 | 5/1985 | Manolis | 123/572 |
| 4,541,399 | 9/1985 | Tanaka et al. | 123/572 |
| 4,597,372 | 7/1986 | Furukawa | 123/572 |
| 4,656,991 | 4/1987 | Fukuo et al. | 123/572 |
| 4,760,833 | 8/1988 | Tatyrek | 123/572 |

*Primary Examiner*—Andrew M. Dolinar
*Assistant Examiner*—M. Macy
*Attorney, Agent, or Firm*—Pennie & Edmonds

[57] ABSTRACT

An internal combustion engine is equipped with a crankcase ventilation system in which fresh air flows through a crankcase. The cylinder block of the engine is formed with a fresh air suction port whose one end is opened to the chamber of a crankcase in order to establish communication between a rocker cover chamber and the crankcase chamber. The one end of the fresh air suction port is located in the vicinity of the peripheral surface of a counterweight of a crankshaft. The rotation of the counterweight develops vacuum thereby to suck fresh air from the rocker cover chamber through the fresh air suction port into the crankcase chamber, thereby effecting ventilation in the crankcase.

10 Claims, 5 Drawing Sheets

INTERNAL COMBUSTION ENGINE WITH CRANKCASE VENTILATION SYSTEM

BACKGROUND OF THE INVENTION

1. Field of the Invention

This invention relates in general to improvements in an internal combustion engine, and more particularly to improvements in a crankcase ventilation system for blow-by gas.

2. Description of Prior Art

It is well known that combustion gas is blown out from an engine combustion chamber into a crankcase through a clearance between a piston and a cylinder, thereby producing blow-by gas within the crankcase chamber. The blow-by gas causes deterioration of engine lubricating oil within the crankcase, and therefore sufficient ventilation for the crankcase is required.

A variety of systems for ventilating the crankcase have been proposed and put into practical use. An example of such crankcase ventilation systems is schematically shown in FIG. 5 and disclosed, for example, in Japanese Utility Model Publication No. 61-152714. As shown in FIG. 6, a V-type engine 51 is provided with two rocker cover chambers 52 respectively formed on the right and left banks. A fresh air introduction passage 55 and a blow-by gas return passage 56 forming part of the crankcase ventilation system are both connected to each of the rocker cover chambers 52, 52. The fresh air introduction passage 55 and the blow-by gas return passage 56 are respectively in communication with the upstream side and the downstream side of a throttle valve in an air intake passage 53 leading to combustion chambers of the engine. Accordingly, blow-by gas (indicated by solid arrows) blown into the crankcase flows into the both rocker cover chambers 52, 52 through passages formed through the engine. Then, the blow-by gas is sucked through the blow-by gas return passages 56 into the air intake passage downstream of the throttle valve 54. Broken arrows in FIG. 6 indicate fresh air.

However, difficulties have been encountered in such a crankcase ventilation system, in which ventilation for the crankcase 57 is insufficient. In other words, since the fresh air introduction passage 55 and the blow-by gas return passage 56 are both connected to each rocker cover chamber 52, a major part of the fresh air flown from the fresh air introduction passage 55 to the rocker cover chamber 52 does not flow into the crankcase 57 and is sucked into the air intake passage through the blow-by gas return passage 56.

SUMMARY OF THE INVENTION

It is an object of the present invention to provide an improved internal combustion engine in which sufficient crankcase ventilation can be achieved without addition of any complicated device.

Another object of the present invention is to provide an internal combustion engine equipped with a crankcase ventilation system in which fresh air can be forced into a crankcase to promote ventilation of blow-by gas in the crankcase.

An internal combustion engine according to the present invention is comprised of a cylinder block to which a cylinder head is fixed. A rocker cover is secured to the cylinder head and defines therein a chamber. A first passage is provided to introduce fresh air into the rocker cover chamber. A second passage is provided to establish communication between the rocker cover chamber and an air intake passage. A fresh air suction port is provided to establish communication between the rocker cover chamber and the chamber of a crankcase. An end of the fresh air suction port opens to the crankcase chamber and is located in the vicinity of the peripheral surface of a counterweight of a crankshaft.

With this arrangement, vacuum is generated at the end of the fresh air suction port under rotation of the peripheral surface of the crankshaft counterweight. As a result, fresh air in the rocker cover chamber is forced through the fresh air suction port into the crankcase chamber. Accordingly, even in case that the first passage for fresh air introduction and the second passage for blow-by gas discharge are both connected to the rocker cover chamber, a sufficient amount of fresh air can be supplied to the crankcase chamber, thereby achieving sufficient ventilation of blow-by gas in the crankcase chamber. This effectively prevents lubricating oil from deterioration due to blow-by gas.

DETAILED DESCRIPTION OF THE DRAWINGS

Figure 1:
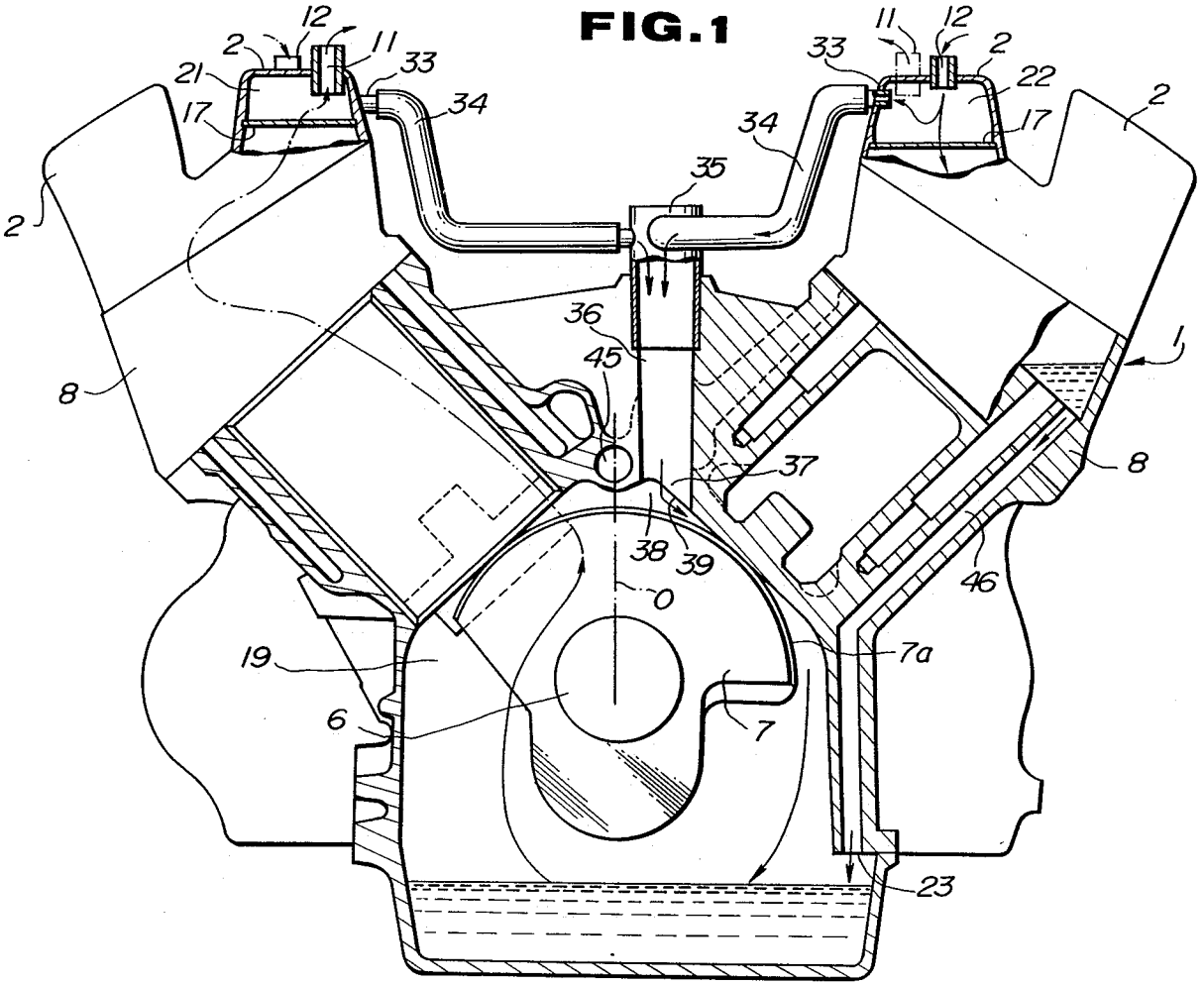
FIG. 1 is a sectional front elevation of an embodiment of an internal combustion engine in accordance with the present invention.
Figure 2:
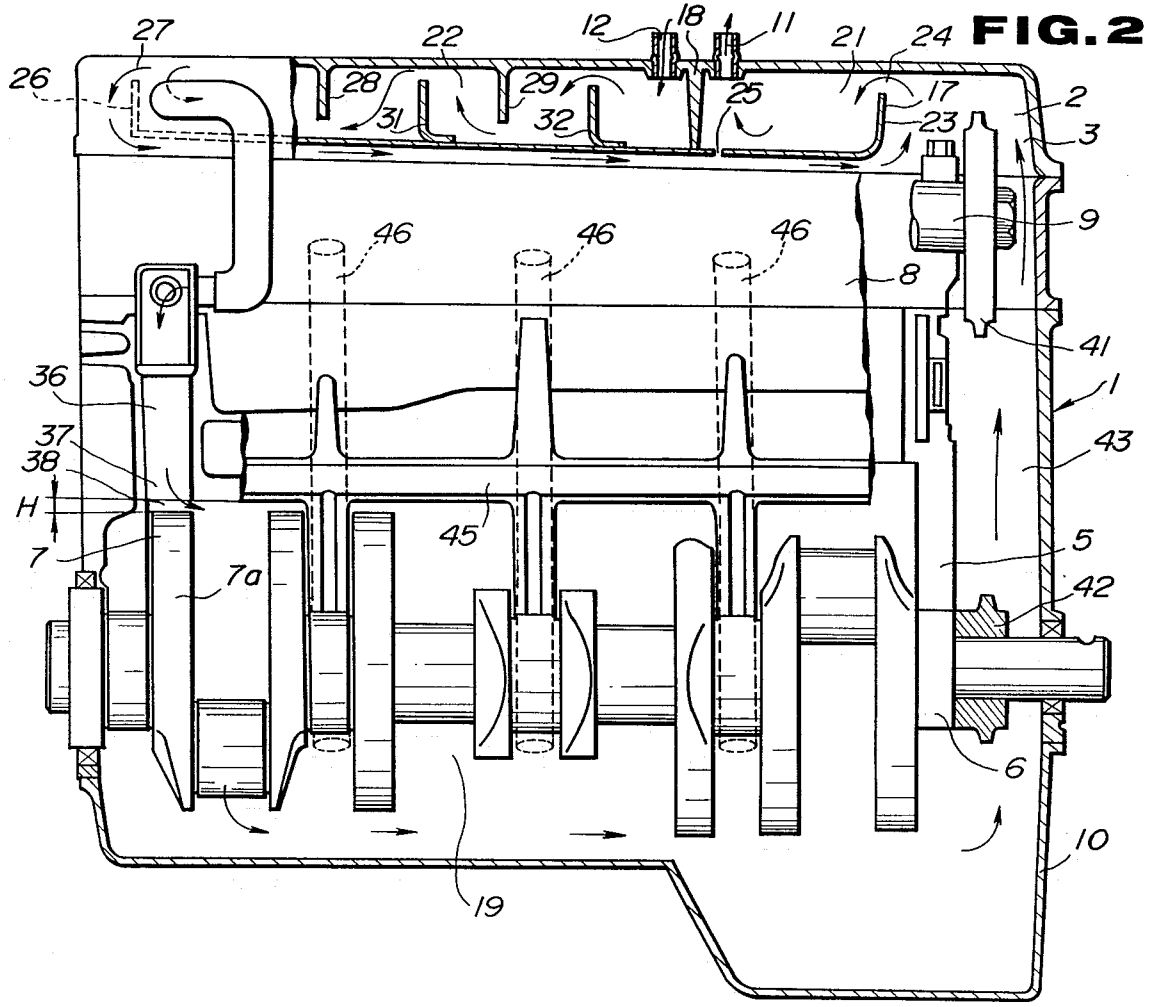
FIG. 2 is a sectional side elevation of the internal combustion engine of FIG. 1.
Figure 3:
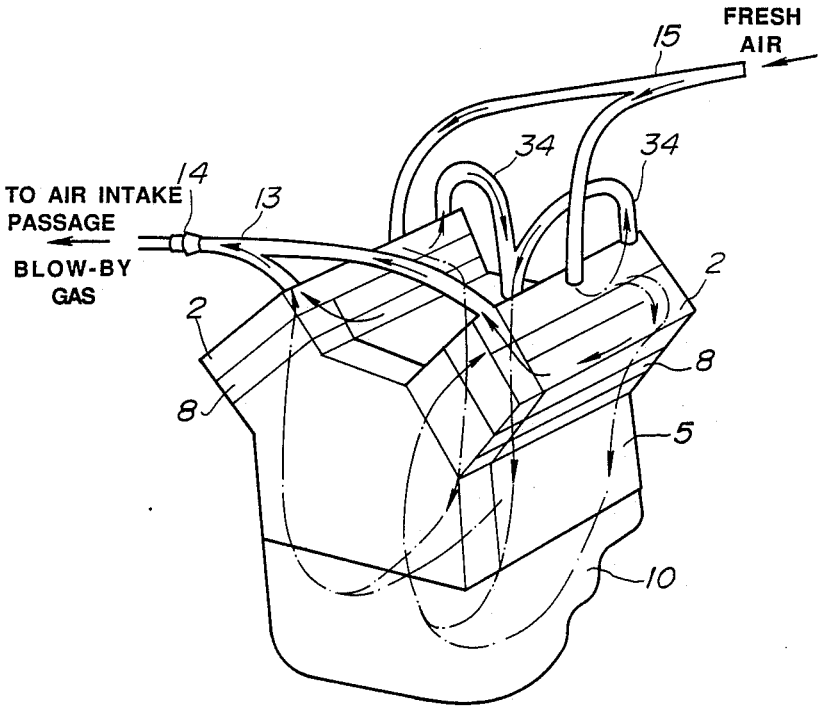
FIG. 3 is a schematic perspective view of the internal combustion engine of FIG. 1.
Figure 4:
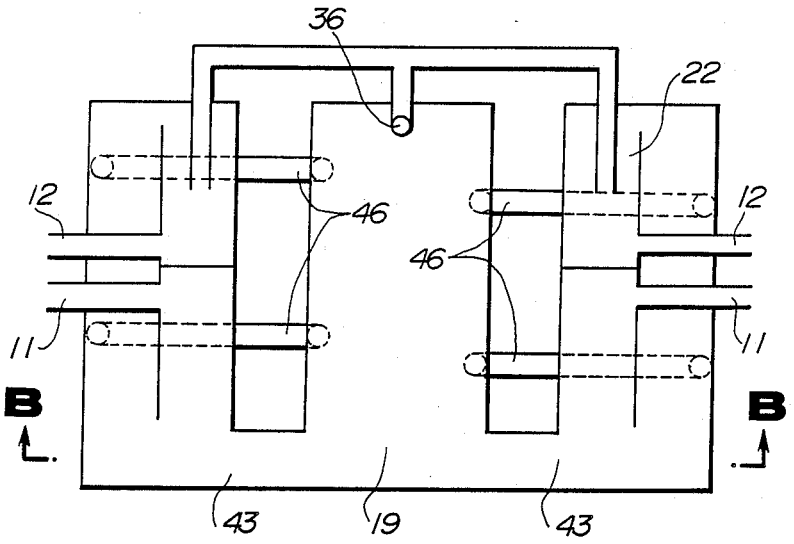
FIG. 4 is a schematic plan representation of the internal combustion engine of FIG. 1, showing an arrangement of passages for gas.
Figure 5:
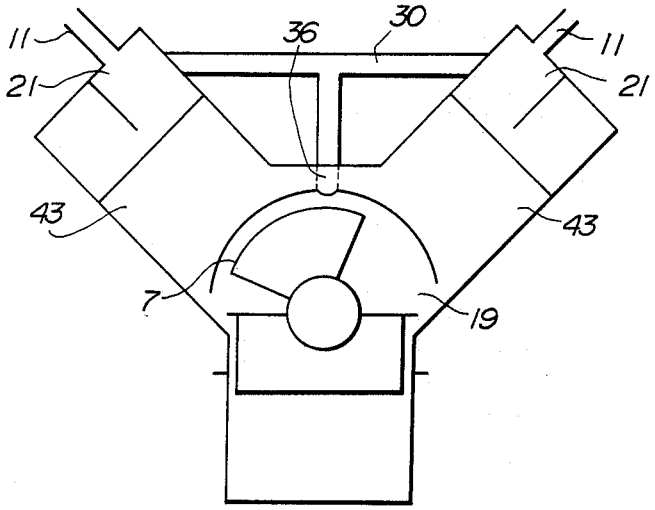
FIG. 5 is a schematic front representation taken in the direction of arrows substantially along the line B—B of FIG. 4.
Figure 6:
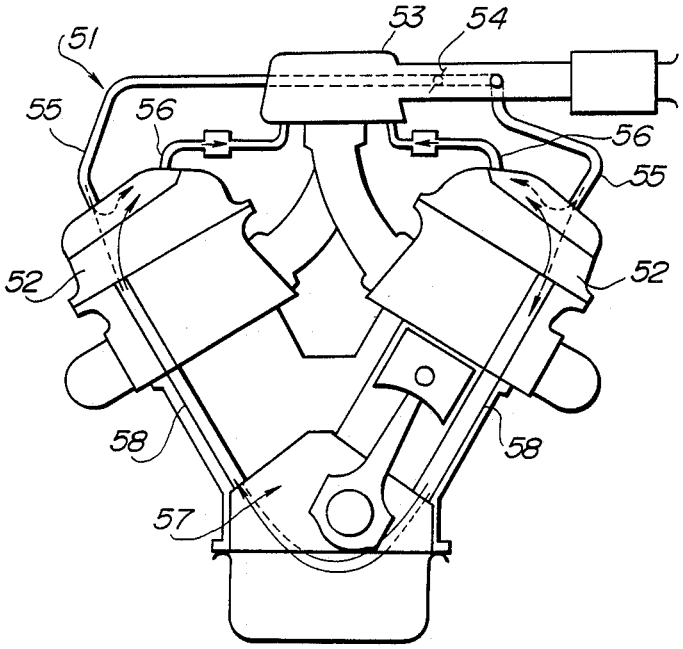
FIG. 6 PRIOR ART
FIG. 6 is a schematic front illustration of a conventional internal combustion engine with a crankcase ventilation system.

Referring now to FIGS. 1, 2 and 3 of the drawings, there is shown an embodiment of an internal combustion engine according to the present invention. FIGS. 4 and 5 schematically illustrate the principle of the embodiment. In this embodiment, the engine is a V-type eight-cylinder engine which has right and left banks as usual. Right and left rocker covers 2, 2 are securely mounted on the respective banks on the top. Each rocker cover 2 is provided with a blow-by gas outlet 11 through which blow-by gas is discharged, and a fresh air inlet 12 through which fresh air enters. The blow-by gas outlet 11 of each rocker cover 2 is communicated through a blow-by gas return passage 13 with an air intake passage (not shown) downstream of a throttle valve, as shown in FIG. 3. Intake air is sucked through the air intake passage into the combustion chambers (not shown) of the engine. A PCV (Positive Crankcase Ventilation) valve 14 is disposed in the blow-by gas return passage 13 in order to regulate the flow amount of return blow-by gas in accordance with intake manifold vacuum. The fresh air inlet 12 of each rocker cover is communicated through a fresh air introduction passage 15 with the air intake passage upstream of the throttle valve, so that fresh air after passing through an air filter (not shown) is supplied to a rocker cover chamber 3 defined within the rocker cover 2. The blow-by gas return passage 13 and the fresh air introduction passage 15 form part of a crankcase ventilation system for sweeping away blow-by gas in a crankcase 19.

A baffle plate 17 is fixedly disposed inside the rocker cover 2 and extends in the longitudinal direction of the rocker cover 2. A partition wall 18 is projected downwardly from the inner wall of the top portion of the rocker cover 2 and located between the blow-by gas outlet 11 and the fresh air inlet 12. The partition wall 18 extends downwardly to contact with the baffle plate 17 and accordingly defines first and second separator chambers 21, 22 on the opposite sides of the partition wall 18. The blow-by gas outlet 11 opens to the first separator chamber 21, whereas the fresh air inlet 12 opens to the second separator chamber 22.

The front end section 23 of the baffle plate 17 is bent upward to define the first separator chamber 21 and so positioned as to form an opening 24 between it and the rocker cover 2. Through the opening 24, blow-by gas flows into the first separator chamber 21. The baffle plate 17 is formed with an oil return hole 25 which is located generally below the blow-by gas outlet 11. Engine lubricating oil separated in the first separator chamber 21 is returned through the oil return hole 25 to the lower section of the rocker cover chamber 3. The rear end section 26 of the baffle plate 17 is bent upward to define the second separator chamber 22 and so positioned as to form an opening 27 between it and the rocker cover 2. Through this opening 27, fresh air is supplied to the rocker cover chamber 3. Additionally, the rocker cover 2 is formed at its inner wall with partition walls 28, 29 which are positioned spaced apart from each other and extend downwardly into the second o separator chamber 22. The lower end of each partition wall 28, 29 is spaced from the baffle plate 17. The baffle plate 17 is provided with partition walls 31, 32 which are positioned spaced apart from each other and located on the opposite sides of the partition wall 29. The upper end of each of the partition walls 31, 32 is spaced from the inner wall surface of the rocker cover 2. These partition walls 28, 29, 31, 32 cause gas to flow in a zigzag pattern through the second separator chamber 22.

The reference numeral 8 designates a cylinder head 8 in each bank of the engine. The cylinder head is fixedly mounted on a cylinder block 5 and provided with a camshaft 9 on which a sprocket 41 is fixedly mounted. The sprocket 41 is drivably connected through a chain (not shown) with a sprocket 42 fixedly mounted on a crankshaft 6. The chain is disposed within a chain chamber 43 located at the front end section of the engine. An oil pan 10 is secured to the bottom of the cylinder block 5 in order to accumulate engine lubricating oil therein. The oil from the oil pan 10 is supplied through an oil passage 45 to a variety of parts requiring lubrication. Lubricating oil from the cylinder head 8 and the rocker cover chamber 3 is returned through an oil passage 46 leading to the oil pan 10.

An elongate fresh air suction port 36 is formed vertically in the cylinder block 5 at the rear end section in order to establish fluid communication between the second separator chamber 22 and the chamber of the crankcase 19. As shown, the fresh air suction port 36 is located generally on the opposite side of the chain chamber 43. Each of the right and left rocker covers 2, 2 is provided with a fresh air outlet 33 which opens to the rear end portion of the second separator chamber 22. The fresh air outlet 33 is fluidly connected to the fresh air suction port 36 in the cylinder block 5 through a pipe 34 and a connector 35. The lower end 37 of the fresh air suction port 36 opens to the chamber of the crankcase 19 and is located near the peripheral surface 7*a* of a counterweight 7 of a crankshaft 6 which counterweight is positioned rear-most of a plurality of counterweights of the crankshaft 6. The lower end 3 of the fresh air suction port 35 is positioned opposite to the peripheral surface 7*a* of the counterweight 7, forming a predetermined clearance 38 therebetween. The counterweight peripheral surface 7*a* is formed arcuate and coaxial with the center axis of the crankshaft 6 as best shown in FIG. 1. The counterweight peripheral surface 7*a* is flat or cylindrical as seen from FIG. 2. The counterweight 7 rotates clockwise as the crankshaft 6 is driven. The fresh air suction port 36 is formed on the side of the right bank with respect to a center vertical plane 0 containing the center axis of the crankshaft 6. As clearly shown in FIG. 1, a cylinder block wall surface 39 formed with the lower end 37 of the fresh air suction port 36 is inclined downwardly in the direction far from the center vertical plane 0. In other words, the clearance 38 formed between the cylinder block wall surface 39 and the peripheral surface 7*a* of the counterweight 7 is generally wedge typed or generally gradually tapered in the direction of rotation of the counterweight 7, in a cross-section along a vertical plane perpendicular to the center axis of the crankshaft 6.

The manner of operation of the thus arranged engine will be discussed hereinafter.

During operation of the engine 1, blow-by gas is blown out into the chamber of the crankcase 19 through a clearance between a piston and an engine cylinder. Most of the blow-by gas flows through the chain chamber 43 to be supplied to the rocker cover chamber 3 as indicated by arrows in FIG. 2. A remaining part of the blow-by gas flows through the oil return passage 46 to be supplied to the rocker cover chamber 3. The thus supplied blow-by gas is introduced into the first separator chamber 21 to separate lubricating oil as indicated by arrows in FIG. 2, and thereafter sucked through the blow-by gas outlet 11 and the blow-by gas return passage 13 into the air intake passage leading to the engine combustion chambers as indicated by arrows in FIG. 3.

As the blow-by gas is returned as discussed above, fresh air flows into the second separator chamber 22 through the fresh air introduction passage 15 and the fresh air inlet 12 as indicated by arrows in FIG. 3. A part of the fresh air flown into the second separator chamber 22 is spreaded through the opening 27 into the rocker cover chamber 3 and flows in the direction from the rearend section to the frontend section of the rocker cover chamber 3 as indicated by arrows in FIG. 2, in which the fresh air is mixed with the blow-by gas. The thus mixed fresh air is introduced through the opening 24 into the first separator chamber 21 and thereafter sucked into the air intake passage through the blow-by gas outlet 11 and the blow-by gas return passage 13.

The remaining part of the fresh air introduced into the second separator chamber 22 is sucked into the fresh air suction port 36 through the fresh air outlet 33, the pipe 34 and the connector 35 as indicated by arrows in FIG. 1. The thus sucked fresh air flows into the chamber of the crankcase 19. At this time, under rotation of the peripheral surface 7*a* of the counterweight 7, vacuum is developed in the clearance 38 between the cylinder block wall surface 39 and the counterweight peripheral surface 7*a*. The vacuum is introduced into the fresh air suction port 36 through the lower end 37 of the suction port 36. By virtue of this vacuum, the fresh air in the second separator chamber 22 is forced into the chamber of the crankcase 19.

Thus, under air suction effect by the peripheral surface *7a* of the counterweight 7, a sufficient amount of fresh air is supplied to the chamber of the crankcase 19, so that the fresh air in the crankcase 19 flows from the fresh air suction port 36 toward the chain chamber 43, i.e., in the direction from the rear end section to the front end section of the engine. As a result, the blow-by gas can be prevented from staying in the crankcase 19, thereby achieving a sufficient ventilation of the crankcase 19.

What is claimed is:

1. An internal combustion engine comprising:

a rocker cover secured to a cylinder head and defining therein a chamber;

means defining a first passage through which fresh air is introduced into the rocker cover chamber;

a crankcase defining thereinside a chamber;

means defining a second passage through which said rocker cover chamber is in communication with an air intake passage;

a crankshaft rotatably supported and including a counterweight, said counterweight being disposed within said crankcase chamber and having a peripheral surface; and means defining a fresh air suction port through which said rocker cover chamber is in communication with said crankcase chamber, said fresh air suction port having a first end which opens to said crankcase chamber and is located in the vicinity of the peripheral surface of said counterweight.

2. An internal combustion engine as claimed in claim 1, wherein said fresh air suction port defining means includes means defining said suction port first end in a surface of a cylinder block defining said crankcase chamber, a clearance being defined between said cylinder block surface and the peripheral surface of said counterweight, said clearance being tapered in direction of rotation of said counterweight.

3. An internal combustion engine as claimed in claim 1, further comprising means for allowing fresh air from said first passage to flow into said fresh air suction port.

4. An internal combustion engine as claimed in claim 3, further comprising means for allowing blow-by gas from said crankcase chamber to flow into said second passage.

5. An internal combustion engine as claimed in claim 4, further comprising means for separating engine lubricating oil from said blow-by gas.

6. An internal combustion engine as claimed in claim 1, wherein said counterweight is located rear-most of a plurality of counterweights of said crankshaft, in longitudinal direction of the engine.

7. An internal combustion engine as claimed in claim 1, wherein said fresh air suction port has a second end which is in communication with said rocker cover chamber.

8. An internal combustion engine as claimed in claim 1, wherein said fresh air suction port is formed in said cylinder block.

9. An internal combustion engine as claimed in claim 6, further comprising means defining a third passage through which the crankcase chamber is in communication with said rocker cover chamber, said third passage being separate from said fresh air suction port and located in a front end section of the engine.

10. An internal combustion engine as claimed in claim 9, further comprising a baffle plate fixedly disposed in said rocker cover chamber, means defining first and second separator chambers between said baffle plate and the inner wall surface of said rocker cover, said first separator chamber is in communication with said second passage and in communication with said third passage, said second separator chamber being in communication with said first passage and in communication with said fresh air suction port.

* * * * *